United States Patent [19]

Le Borgne et al.

[11] Patent Number: 4,574,525

[45] Date of Patent: Mar. 11, 1986

[54] DEVICE FOR OPERATING A SWIVELING BODY ELEMENT

[75] Inventors: Xavier Le Borgne, Saint Brice Sous Foret; Marc Limonne, Neuilly Plaisance, both of France

[73] Assignee: Regie Nationale des Usines Renault, Boulogne-Billancourt, France

[21] Appl. No.: 597,086

[22] Filed: Apr. 5, 1984

[30] Foreign Application Priority Data

Apr. 6, 1983 [FR] France ..... 83 05582

[51] Int. Cl.[4] ..... E05F 11/00; F41H 5/22

[52] U.S. Cl. ..... 49/324; 49/256; 49/354; 89/36.14

[58] Field of Search ..... 49/324, 339, 354, 40, 49/255, 256; 89/36 R, 36 L

[56] References Cited

U.S. PATENT DOCUMENTS 3,262,227 7/1966 Pentecost ..... 49/354
4,004,494 1/1977 Mechulam et al. ..... 89/36 L

FOREIGN PATENT DOCUMENTS 542854 6/1957 Canada ..... 49/255

*Primary Examiner*—Philip C. Kannan
*Attorney, Agent, or Firm*—Oblon, Fisher, Spivak, McClelland & Maier

[57] ABSTRACT

A device for operating a swiveling or mobile body element intended particularly to seal an access opening to a control or observation post by a cover that can be moved angularly around a pivot pin fastened to the body by means of an operating and locking handle. The operating handle includes a gripping element and a control element. A hinge and connecting pin are provided between these elements and an interlocking mechanism between the control element and the pivot pin.

6 Claims, 4 Drawing Figures

DEVICE FOR OPERATING A SWIVELING BODY ELEMENT

BACKGROUND OF THE INVENTION

The present invention relates to a device for operating a swiveling or mobile body element intended for example to seal an access opening to a control or observation post. The device is constructed so that the mobile element can be moved angularly around a pivot pin extending into the body, by an operating handle operated from said post. The invention relates more particularly to the arrangement of the pivot pin and the operating handle which facilitates opening, closing and locking movements of the mobile element, and resists an accidental opening of the mobile element.

SUMMARY OF THE INVENTION

According to the invention, the operating handle includes a gripping element and a control element, a hinge and connecting pin between these elements and an interlocking mechanism between the control element and the pivot pin.

According to a preferred embodiment of the invention, the interlocking mechanism uses an operating element mounted to move on the handle, a bolt fixed to the operating element and a catch in the pivot pin, so that the engagement of the bolt in the catch automatically results from the rotation of the handle around a control shaft orthogonal to the pivot pin of the mobile element.

Such a device allows the swiveling operation of the mobile element in the desired direction and its securement and safety locking.

Another characteristic of the device of the invention consists in the use of a cam and eccentric, carried by the handle, which move the mobile element along the length of the pivot pin to assure the locking of the mobile element with the body, for example during the sealing of the access opening to the control or observation post.

A third characteristic of the device is the provision of a simple means for adjusting the mobile element by use of an adjusting flange surmounted by a sleeve surrounding the pivot pin and engaged in another sleeve fastened to the support for the mobile element, together with a clearance adjusting seal.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
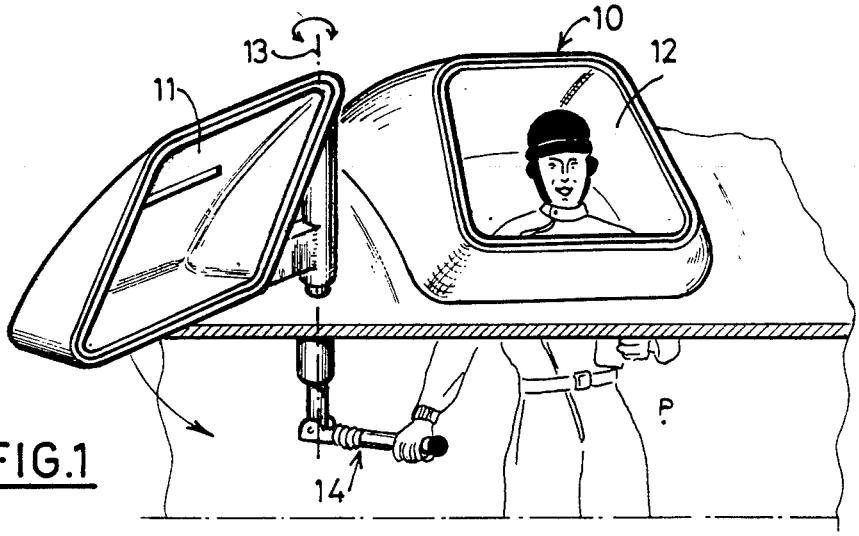
FIG. 1 is a partial view of the vehicle equipped with a swiveling body element of the invention.

FIG. 1 is a partial view of a vehicle having body 10 provided with an access opening 12 to a chamber p containing, for example, a control or observation post. Body 10 carries a mobile element 11 such as a cover or a glass covered observation window for the opening 12, the mobile element 11 being mounted to move angularly around an axis of a pivot pin 13. Element 11 rigidly fixed to pivot pin 13 which passes through the wall of body 10 and carries at its lower end, located in chamber p, an operating and locking handle 14.

Figure 4:
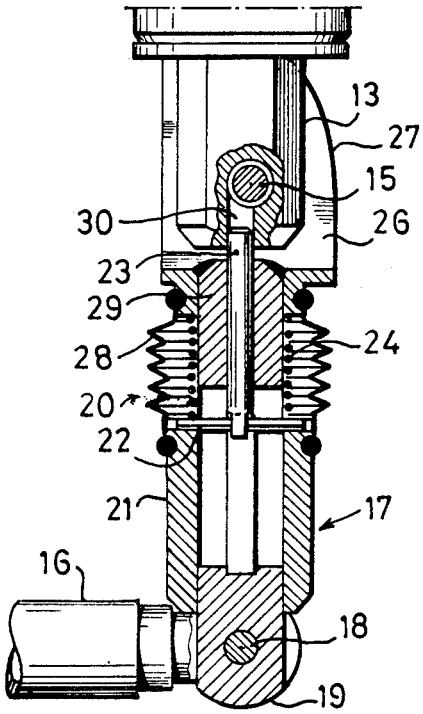
FIG. 4 is a partial view of the device of the invention in the safety and locked position.
Figure 2:
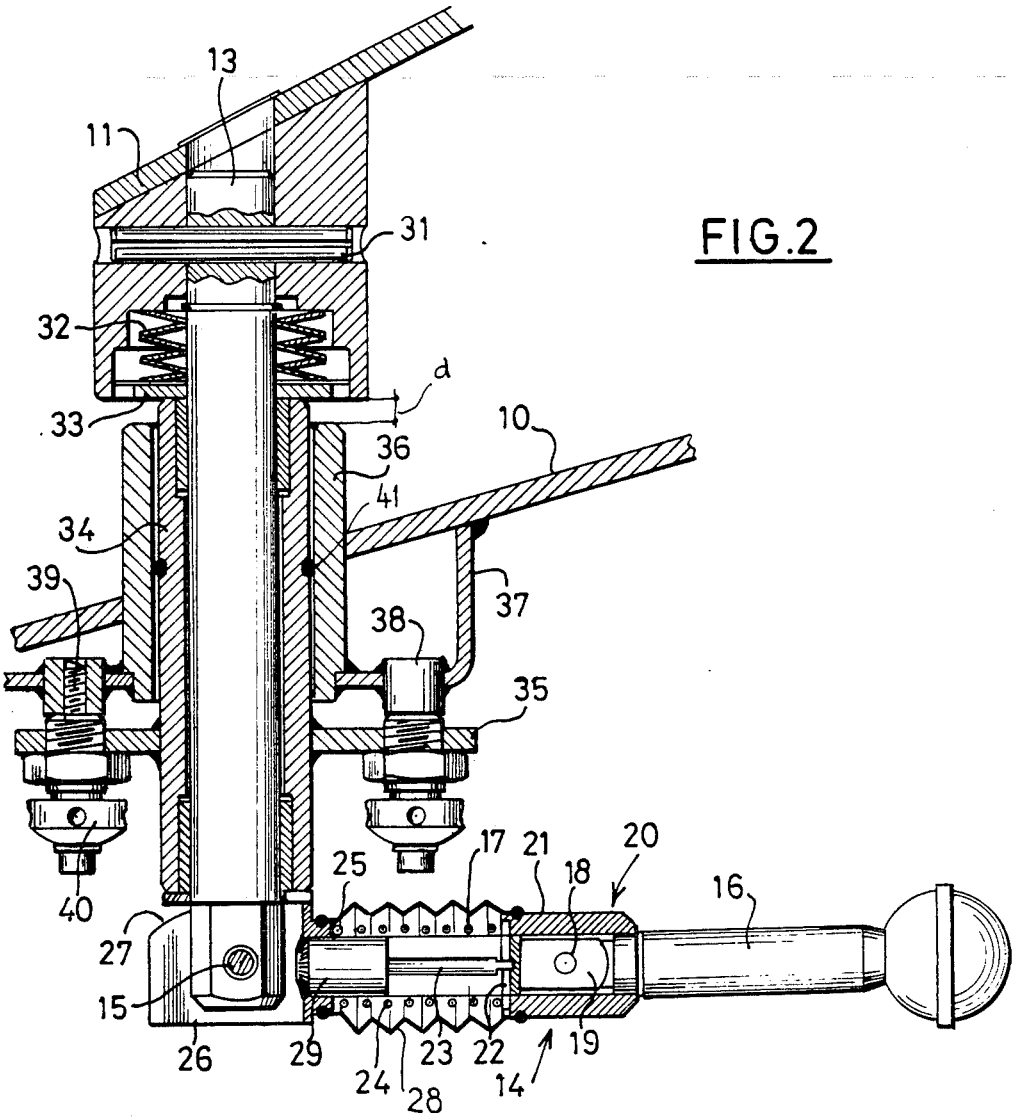
FIG. 2 is a view in section of the device of the invention in the unlocked position.

As is shown in FIG. 2, handle 14 is mounted to swing on a control shaft 15 mounted in, and orthogonal to, pivot pin 13. The handle 14 includes a gripping element 16 and a control element 17. Elements 16 and 17 are connected to one another by a hinge pin 18 in a first yoke 19. An interlocking element 20 forming part of control element 17 includes a control ring 21 mounted to slide on first yoke 19, and between control element 17 and gripping element 16 to lock elements 16 and 17 in coaxial alignment (FIG. 2). Ring 21 cooperates with a pin 22 to which a sliding bolt in the shape of a locking pin 23 is hooked so that movement of ring 21 also moves locking pin 23. A spring 24 is mounted in the compressed state between pin 22 and shoulder 25 at the base of a second yoke which connects element 17 to pin 13. The second yoke has lugs 26 to which the shaft 15 is connected. The lugs 26 are shaped like a cam with a profile 27 which is eccentric in relation to control shaft 15. Spring 24, pin 22 and pin 23 are protected by a bellows 28 whose ends are respectively secured on the second yoke and on ring 21. Pin 23 is engaged to slide in an axial bore of tail end 29 of the second yoke and can be interlocked by the sliding operation of ring 21 in a catch 30 of pivot pin 13. The catch 30 consists of a hole which is drilled in the shaft of pivot pin 13 and which extends into the housing of control shaft 15 of pivot pin 13 as is shown in FIG. 4.

Figure 3:
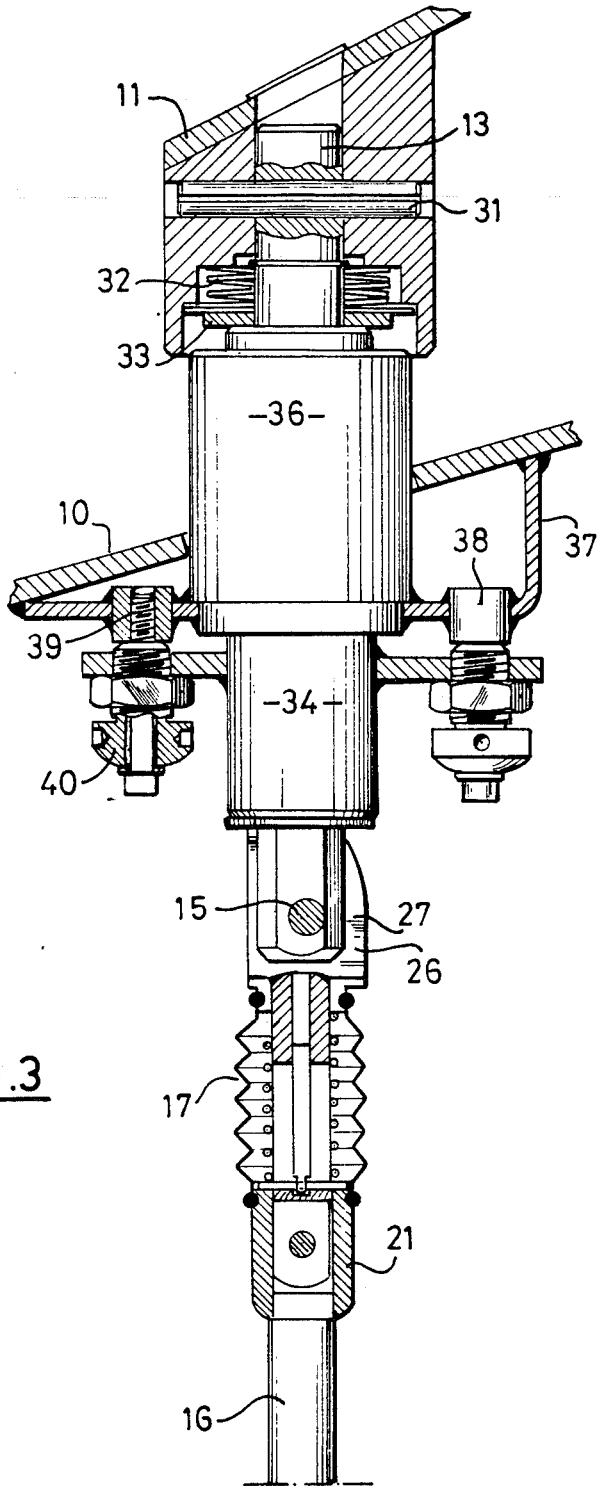
FIG. 3 is a view in section of the device of the invention in the locked position.

In FIGS. 2 and 3, mobile element 11 is clearly seen as fastened with a pin 31 on pivot pin 13. The base of element 11 carries a chamber centered on pivot pin 13 in which a stack of Belleville springs 32 is housed. The stack of springs 32 rests on a sleeve 34 through the intermediary of a washer 33. This sleeve carries an adjustment flange 35, and the unit thus constituted is part of mobile element 11. Mobile element 11 can, for example, be supported in a wall of body 10 which carries for this purpose a sleeve 36 fastened by welding on body 10 by means of a bracket 37. Bracket 37 carries three nuts 38, only two of which can be seen in FIGS. 2 and 3, and which are distributed at the vertices of a triangle inscribed on adjustment flange 35. Flange 35 is held together with sleeve 36 by fastening screw 39 in nut 38. There are also provided adjusting screws 40 placed concentrically to fastening screws 39. The ends of screws 40 are resiliently held relative to the three welded nuts 38 by the springs 32, and the adjustment of screws 40 makes possible the correct adjustment of flange 35 in relation to the body and consequently the simultaneous adjustment of sleeve 34, pivot pin 13 and element 11 in relation to sleeve 36 and opening 12. A deformable seal 41 placed between sleeve 34 and sleeve 36 provides mounting and adjusting clearances. The operating mode of the device will become apparent from examination of FIGS. 2 to 4.

In FIG. 2, which shows the device in the unlocked state, Belleville springs 32 exert a reaction force on body element 11. This reaction force has the effect of holding element 11 at a distance "d" from the top of sleeve 36 sufficient to allow the free rotation of element 11 under the action of handle 14 when handle 14 is positioned in a horizontal plane around the shaft of pivot pin 13, for the purpose of uncovering or sealing opening 12.

In FIG. 3, handle 14 has been rotated about shaft 15 from the position that it occupied in FIG. 2, into a vertical plane, i.e. parallel to pin 13. The flat end of cam 27 rests on stationary sleeve 34. During rotation to the position of FIG. 3, the profile 27 of cam 26 pulls the pin 13 downward relative to sleeve 34 and so exerts a pulling force on pivot pin 13 which drives downward pin 31 and element 11. The stack of Belleville springs is thus compressed between element 11 and washer 33 supported on sleeve 34, and the mobile element 11 therefore is secured against opening 12.

In FIG. 4, gripping element 16 has been rotated from the position shown in FIG. 3. This is done by raising ring 21 against the biasing of spring 17, for the purpose of uncovering yoke 19. Such raising of ring 21 has the effect not only of permitting rotation of element 16, but also of interlocking pin 23 in catch 30 and so providing a safety for the locking of handle 14 in the position shown in FIG. 3 in which element 11 occupies a sealing position. Consequently, it is seen that the interlocking element 20 essentially provides a safety function against the risk of an undesired operation of mobile element 11.

Of course, numerous modifications can be made to the device particularly in connection with the design of the interlocking mechanism described and shown, without going outside the scope of the invention.

What is claimed as new and desired to be secured by letters patent of the United States is:

1. In a body defining a control or observation post and having an opening and a mobile element rotatably mounted on said body and movable into a position for sealing said opening, a device for operating said mobile element, said device comprising:

a pivot pin having one end fixed to said mobile element and a second end extending into said body, whereby said pivot pin is rotatably mounted in said body;

a control element connected to said second end of said pivot pin;

a gripping element pivotally connected to said control element via a connecting pin, said gripping element and control element together defining a locking handle; and means for interlocking said control element and said pivot pin.

2. The device of claim 1 wherein said interlocking means comprise:

an operating element mounted on said control element for movement toward and away from said pivot pin;

a catch associated with said pivot pin; and a pin movable with said operating element and engageable with said catch to lock said locking handle and said pivot pin.

3. The device of claim 2 wherein said operating element comprises a control ring slidable on said control element and a spring biasing said pin away from said catch.

4. The device of claim 2 wherein said control element is pivotally connected to said pivot pin via a control shaft in said pivot pin and extending orthogonal to an axis of rotation of said pivot pin, and wherein said pin and catch are oriented such that said pin engages said catch in a first position wherein said pivot pin and said control element are aligned.

5. The device of claim 4 wherein said control element includes a yoke rotatable on said control shaft and having a cam surface eccentric to said control shaft, said device further comprising:

means supporting said pivot pin for movement along said axis of rotation thereof;

means for biasing said pivot pin in a direction out of said body; and adjustable stop means for adjusting a position of said pivot pin along said axis of rotation, wherein engagement of said cam surface with said means for supporting during rotation of said locking handle about said control shaft to said first position retracts said pivot pin into said body to seal said opening.

6. The device of claim 5 wherein said means for supporting comprise:

a first sleeve axially adjustably carried on said body by a second sleeve via said stop means, said pivot pin extending through said first sleeve; and a seal between said second sleeve and said first sleeve.

* * * * *